United States Patent [19]

Goldman et al.

[11] Patent Number: 4,950,852

[45] Date of Patent: Aug. 21, 1990

[54] ELECTRIC CIRCUIT BREAKER ARC CHUTE COMPOSITION

[75] Inventors: Ira B. Goldman, Waterbury; Raymond K. Seymour, Plainville, both of Conn.

[73] Assignee: General Electric Company, New York, N.Y.

[21] Appl. No.: 331,730

[22] Filed: Apr. 3, 1989

[51] Int. Cl.[5] ..... H01H 33/10

[52] U.S. Cl. ..... 200/144 C; 200/149 A

[58] Field of Search ..... 200/144 C, 149 A

[56] References Cited

U.S. PATENT DOCUMENTS

| | | | |
|---|---|---|---|
| 2,005,684 | 6/1935 | Sachs | 200/144 R |
| 2,551,822 | 5/1951 | Bingenheimer et al. | 200/144 R |
| 2,917,607 | 12/1959 | Sterling | 200/144 C |
| 3,407,155 | 10/1968 | Casebolt | 260/17.3 |
| 4,375,021 | 2/1983 | Pardini et al. | 200/147 B |
| 4,511,773 | 4/1985 | Heft et al. | 200/144 C |
| 4,733,032 | 3/1988 | Pardini | 200/144 C |
| 4,748,301 | 5/1988 | Goldman et al. | 200/144 C |

*Primary Examiner*—Robert S. Macon

*Attorney, Agent, or Firm*—Richard A. Menelly; Walter C. Bernkopf; Fred Jacob

[57] ABSTRACT

A current limiting circuit breaker having a pair of separable contacts closely spaced for electrodynamic repulsion upon the occurrence of a short circuit overload condition utilizes an arc chute to cool and extinguish the arc that occurs when the contacts become separated. The arc chute contains a plurality of metal arc plates supported by side plates which also assist in cooling and extinguishing the arc. The side plates are formed from a suspension of wollastonite fibers within a melamine resin matrix. The wollastonite provides good mechanical strength and temperature-resistance properties while the melamine provides a continuous source of arc-quenching gaseous molecular compounds.

19 Claims, 2 Drawing Sheets

ELECTRIC CIRCUIT BREAKER ARC CHUTE COMPOSITION

BACKGROUND OF THE INVENTION

U.S. Pat. No. 4,375,021, in the name of Franco P. Pardini and Francesco DeVizzi, describes the use of a magnetic assembly arranged about a pair of circuit breaker contacts for electrodynamically repulsing the contacts and for electrodynamic motivation of the arcs that occur when the contacts become separated. The arc chute used within the breaker for cooling and extinguishing the arc is formed by enfolding a metal strip partially around an insulating support substrate.

U.S. Pat. Nos. 2,005,684 and 2,551,822 both teach arc chute assemblies that contain a composite structure of one material having good arc resistant properties such as asbestos alongside another material having good physical support properties.

When the Pardini et al. circuit breaker is used to interrupt short circuit current at rated voltages in excess of 400 volts, it has been determined that the arc chute side supports interfere with the arc extinguishing process at higher arc temperatures and higher arc voltages. Asbestos materials, having excellent high temperature and electrical resistance properties, are no longer available to the electrical industry by legislative mandate.

U.S. Pat. No. 4,733,032 entitled "Electric Circuit Breaker Arc Chute Composition" describes a two-layer laminate structure for arc plate side supports wherein the layer facing the arc consists of a melamine resin impregnated cloth fiber while the opposite layer consists of a melamine resin impregnated glass fiber. The opposite layers must be color-coded to insure that the cloth fibers face the arc rather than the glass fibers. Should the glass fibers become subjected to the temperatures generated within the arc chute, the low ionization potential elements within the glass fibers would become ionized and thereby interfere with the arc extinction process.

U.S. Pat. No. 4,748,301 entitled "Electric Circuit Breaker Arc Chute Composition" describes a three-layer laminate structure for arc plate side supports. This Patent uses materials similar to those described within the aforementioned U.S. Pat. No. 4,733,032 and includes an extra layer to the laminate structure to eliminate the need for orienting the arc plates with respect to the arc.

U.S. Pat. No. 4,511,773 entitled "Molding Composition for Arc Circuit Breakers", which Patent is incorporated herein for reference purposes describes a ceramic arc chute assembly consisting essentially of a mixture of wollastonite powder calcined with phosphoric acid. The composition is an effective substitute for asbestos arc chute assemblies but is quite expensive to manufacture and requires vigorous process control.

U.S. Pat. No. 3,407,155 describes the use of wollastonite fibers as fillers for circuit breaker housings to improve the arc resistant properties of such housings. U.S. Pat. No. 2,917,607 entitled "Arc Resistant Molded Members" teaches the elimination of arc chutes within circuit breakers wherein the circuit breaker housings are fabricated from thermoset resins such as melamine containing inorganic fillers such as wollastonite.

The instant invention proposes the use of specific wollastonite fibers suspended within melamine resin as a substitute material for the calcined wollastonite arc chute assembly described within the aforementioned U.S. Pat. No. 4,511,773.

SUMMARY OF THE INVENTION

Increased interruption ratings are attainable within current-limiting circuit interrupters by means of arc chute support members fabricated from wollastonite fibers suspended within a melamine resin matrix. The high temperature-resistance of the wollastonite combined with the efficient arc-quenching property of the melamine provides rapid arc extinction at the elevated arc temperatures.

DESCRIPTION OF THE PREFERRED EMBODIMENT

Figure 1:
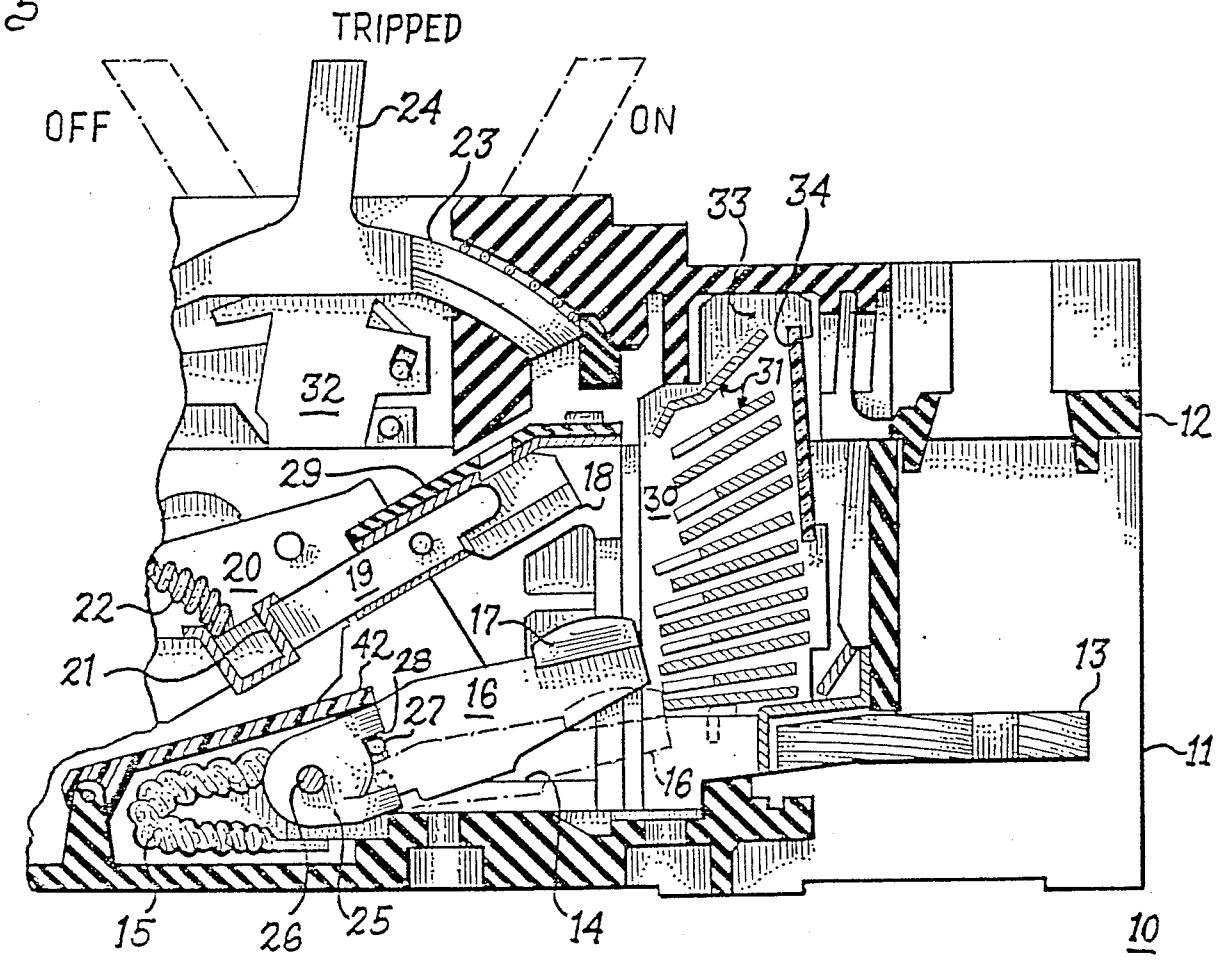
FIG. 1 is a side view of a current limiting circuit breaker containing the arc chute of the invention depicted in partial section.

A molded case circuit breaker 10, similar to that described within the aforementioned patent to Pardini et al, is shown in FIG. 1 to consist of an insulative case 11 and an insulative plastic cover 12. A line terminal 13 connects with a bottom contact carrier 16 by means of a line strap 14 and a copper braid conductor 15. A bottom contact 17 is welded or brazed to the bottom contact carrier for cooperating with an upper contact 18 welded or brazed to an upper contact carrier 19, as indicated. The upper contact carrier 19 is operated by means of an operating mechanism generally depicted at 20 and is biased in a clockwise direction by means of a contact spring 22 to insure good electrical connection between the upper and lower contacts 18, 17, when the operating handle 24 is moved to its "ON" position. The operating handle cooperates with the operating mechanism 20 and crossbar 21 by means of the handle skirt 23 and the mechanism side frames 32, one of which is removed to clearly show the lower contact carrier support 25 and pivot 26. The lower contact carrier pivots independently from the "ON" position to the "TRIPPED" position shown in FIG. 1, under automatic operation of the operating mechanism wherein the pin 27 attached to the lower contact arm carrier 16 is at its uppermost position within the slot 28 formed within the support 25. When the operating handle is "ON" and contacts are in the "closed" position, the pin 27 is then at its bottom most position within the slot. In order for the upper and lower contact carriers 19, 16 to be closely spaced together for maximum electrodynamic repulsion upon short circuit conditions through the contacts, an insulating plate 42 is arranged between the contact carriers to prevent inadvertent conduction between the carriers. An upper insulated plate 29 is positioned above the upper contact carrier 19 to act as a stop for the upper contact carrier when driven to its tripped position and to assist in motivating the arc away from the contacts into the arc chute 30 which is positioned intermediate the contacts and the line terminal 13. The arc chute 30 contains a plurality of spaced metallic arc plates 31 supported by a pair of side supports 33, one of which is removed to show the location of the arc plates with respect to the back support 34. The arc plate side supports 33 and the back support 34 are formed from a high temperature-resistant insulative fiber material.

Figure 3:
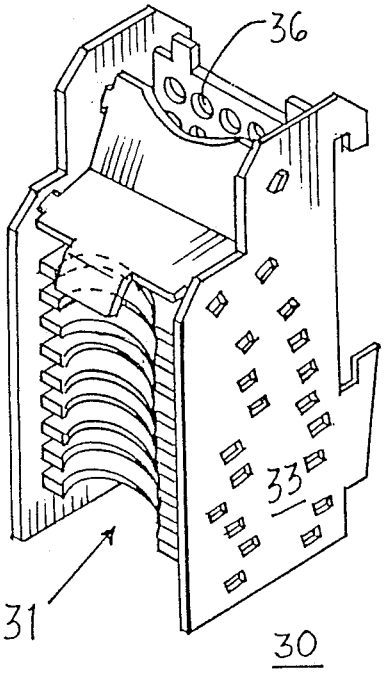
FIG. 3 is a top perspective view of the arc chute of FIG. 2 after assembly.
Figure 2:
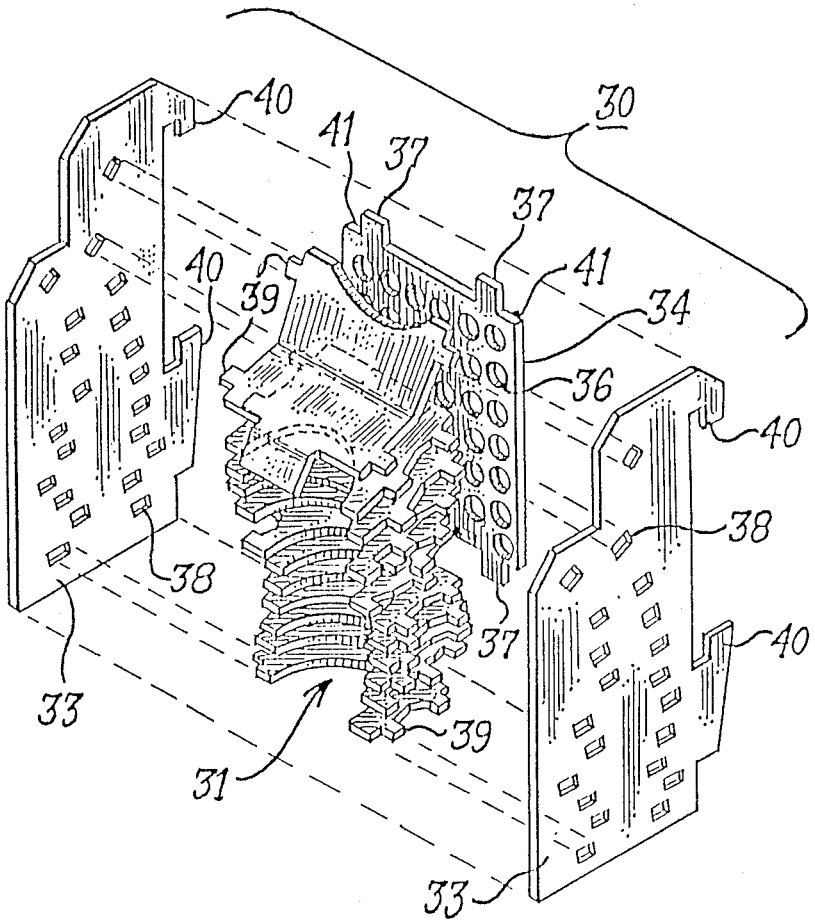
FIG. 2 is an enlarged front perspective view of the arc chute of FIG. 1 with the sides and back sections in isometric projection from the arc plates.

The configuration of the arc chute 30 is best seen by referring to FIGS. 2 and 3 wherein the arc chute side supports 33 contain a plurality of slots 38 punched or formed therein for receiving a corresponding plurality of tabs 39 which extend from both sides of the metallic arc plates 31. The side supports are attached to the back support 34 by arranging the hooked projections 40 on the side supports over the edges 41 formed on the top surface of the back support next to or outboard the pair of upstanding tabs 37 on the top surface of the back support. In operation, the arc is electrodynamically driven within the arc plates 31 wherein it is cooled and quenched as rapidly as possible. To assist in the arc-quenching process, the side supports 33 include a gas-evolving resin material which becomes heated and evolves a substantial quantity of disassociated gaseous material, which immediately becomes expelled from the arc chute through a series of holes 36 arranged within the back support.

To insure that the arc chute side supports 33 are capable of sustaining both the high voltage gradiant developed across the arc plates and the high temperatures associated with the arc, the side plates are fabricated from melamine resin to which wollastonite fibers have been added as a filler. The wollastonite fibers mainly comprised fibrous calcium silicate having the formula, $CaSiO_3$. The melamine resin is made by condensing formaldehyde with melamine, the melamine comprising the general formula $C_3H_6N_6$. The melamine resin thereby combining in such a manner as to readily evolve ion-neutralizing gaseous materials upon reaching elevated temperatures. Tests comparing the wollastonite-filled melamine resin arc chute side supports of the instant invention with the glass-filled melamine resin side supports described in aforementioned U.S. Pat. No. 4,748,301 and cotton-filled melamine resin state-of-the-art side supports were performed with the following results.

Arc chutes containing the arc chute side supports depicted in FIGS. 2 and 3 were installed in circuit breakers rated at 10,000 amperes and 600 volts. For test purposes, currents were continuously passed through the circuit breakers from 8000–14000 amps. The circuit breakers were caused to trip and the arc voltages developed across the arc chutes during interruption were measured to determine the highest arc voltage over the time increment required to extinguish the arcs. The arc voltage magnitude is used herein to determine the efficiency of the arc chute materials for extinguishing the arc. The generation of the arc voltage reduces the arc currents while the arc chute arrangement cools the arc causing extinction of the arc when the current goes to zero. The higher the arc voltage generated during interruption, the higher the available line voltage needed to maintain the arc and hence the arc becomes extinguished. One of the benefits of the melamine material is the out-gassing of negative ion-producing materials to neutralize the positive ions that are known to comprise the majority charge carried in the arc stream. The benefit of the fiber filler materials lies in their high temperature strength properties which allows the arc chutes to sustain the high arc temperatures generated by the arc energy. The arc voltages across the wollastonite-filled arc chutes were found to exceed the arc voltages generated across the glass-filled arc chutes while being equal to or greater than the voltage generated across the cotton-filled arc chutes.

The major advantage of the wollastonite-filled melamine resin over cotton-filled resin lies in the capability of forming the wollastonite-filled arc chute side supports in a standard plastic molding operation whereas cotton-filled melamine resin is not moldable, and hence must be made by a lamination process that is not economically feasible for such use in high speed circuit breaker manufacturing operations.

Having thus described our invention, what we claim as new and desire to secure by Letters Patent is:

1. A molded case circuit breaker comprising:
a molded plastic case and cover;
a pair of separable contacts within said case;
an operating mechanism moving said contacts between open and closed positions; and
an arc chute facing said contacts and extinguishing an arc which occurs when said contacts become separated during overcurrent conditions, said arc chute including a plurality of spaced metal plates supported between a pair of side supports and an apertured back support, said side supports each comprising a resin reinforced with wollastonite fibers.

2. The circuit breaker of claim 1 wherein said resin comprises melamine resin.

3. The circuit breaker of claim 1 wherein said melamine resin comprises the combination of melamine with formaldehyde.

4. The circuit breaker of claim 1 wherein said melamine has the composition $C_3H_6N_6$.

5. The circuit breaker of claim 1 wherein the wollastonite has the composition $CaSiO_3$.

6. A molded case circuit breaker comprising:
a molded plastic case and cover;
a pair of separable contacts within said case;
an operating mechanism moving said contacts between open and closed positions; and
an arc chute facing said contacts and extinguishing an arc which occurs when said contacts become separated during overcurrent conditions, said arc chute including a plurality of spaced metal plates supported between a pair of side supports and an apertured back support, said back support comprising a resin reinforced with wollastonite fibers.

7. The circuit breaker of claim 6 wherein said melamine resin comprises the combination of melamine with formaldehyde.

8. The circuit breaker of claim 7 wherein said melamine has the composition $C_3H_6N_6$.

9. The molded case circuit breaker of claim 6 wherein said wollastonite has the composition $CaSiO_3$.

10. An arc chute comprising:
a pair of opposing apertured side supports and a perforated back support;
a plurality of metal plates having tabs extending from opposing edges, said tabs being located within corresponding apertures formed within said side supports;
said side supports having hooked extensions formed within a top surface and arranged over edges formed within a top surface of said back support; and
said side supports each comprising a resin reinforced with wollastonite fibers.

11. The arc chute of claim 10 wherein said resin comprises melamine resin.

12. The arc chute of claim 11 wherein said melamine resin comprises the combination of melamine with formaldehyde.

13. The arc chute of claim 11 wherein said melamine has the composition $C_3H_6N_6$.

14. The arc chute of claim 10 wherein said wollastonite has the composition $CaSiO_3$.

15. An arc chute comprising:

a pair of opposing apertured side supports and a perforated back support;

a plurality of metal plates having tabs extending from opposing edges, said tabs being located within corresponding apertures formed within said side supports;

said side supports having hooked extensions formed within a top surface and arranged over edges formed within a top surface of said back support; and said back support comprising a resin reinforced with wollastonite fibers.

16. The arc chute of claim 15 wherein said resin comprises melamine resin.

17. The arc chute of claim 16 wherein said melamine resin comprises the combination of melamine with formaldehyde.

18. The arc chute of claim 16 wherein said melamine has the composition $C_3H_6N_6$.

19. The arc chute of claim 15 wherein said wollastonite has the composition $CaSiO_3$.

* * * * *